US007056141B2

(12) United States Patent
Moffett et al.

(10) Patent No.: US 7,056,141 B2
(45) Date of Patent: Jun. 6, 2006

(54) ELECTRONIC LATCH INTERCONNECT FOR PDA/CELL PHONE

(75) Inventors: Howard Moffett, Park City, UT (US); Brad Brown, Salem, UT (US); Steve Rasmussen, Provo, UT (US); Marcus Darrington, Provo, UT (US)

(73) Assignee: ATL Technology LC, Springville, UT (US)

( * ) Notice: Subject to any disclaimer, the term of this patent is extended or adjusted under 35 U.S.C. 154(b) by 0 days.

(21) Appl. No.: 10/742,652

(22) Filed: Dec. 19, 2003

(65) Prior Publication Data

US 2004/0185721 A1 Sep. 23, 2004

Related U.S. Application Data

(60) Provisional application No. 60/435,955, filed on Dec. 20, 2002.

(51) Int. Cl.
*H01R 4/50* (2006.01)
*H01R 13/625* (2006.01)

(52) U.S. Cl. ..... 439/346; 439/357; 439/540.1

(58) Field of Classification Search ..... 439/357, 439/345–346, 353
See application file for complete search history.

(56) References Cited

U.S. PATENT DOCUMENTS 3,543,218 A * 11/1970 Archer ..... 439/346
5,224,866 A * 7/1993 Nakamura et al. ..... 439/81
5,584,713 A * 12/1996 Kato et al. ..... 439/188
5,630,726 A * 5/1997 Baldwin ..... 439/346
5,782,646 A * 7/1998 Broadfield et al. ..... 439/346
5,876,248 A 3/1999 Brunker et al. ..... 439/608
6,171,138 B1 1/2001 Lefebvre et al. ..... 439/500
6,203,335 B1 3/2001 Chang ..... 439/79
6,231,390 B1 5/2001 Chang ..... 439/607
6,302,722 B1 10/2001 Simmel ..... 439/374
6,341,218 B1 1/2002 Poplawsky et al. ..... 455/90
6,383,010 B1 * 5/2002 Mayo et al. ..... 439/357
6,398,577 B1 * 6/2002 Simmel et al. ..... 439/357
6,454,592 B1 * 9/2002 Takagi ..... 439/378
6,607,397 B1 * 8/2003 Zhang et al. ..... 439/357
6,638,092 B1 * 10/2003 Groebe et al. ..... 439/341

* cited by examiner

*Primary Examiner*—Hae Moon Hyeon
(74) *Attorney, Agent, or Firm*—Thorpe, North & Western LLP

(57) ABSTRACT

A method and apparatus relating to an interconnection system configured for a portable electronic device. The interconnection system includes an interface connector having a power port configured to be positioned at a peripheral portion of the portable electronic device. The interconnection system is directed to a latching contact mechanism that provides both electrical engagement and a latching mechanism between a power connector and the interface connector disposed in the portable electronic device.

15 Claims, 12 Drawing Sheets

ELECTRONIC LATCH INTERCONNECT FOR PDA/CELL PHONE

This application claims priority of application Ser. No. 60/435,955, filed on Dec. 20, 2002.

FIELD OF THE INVENTION

The present invention relates generally to interconnections for a portable electronic device. More particularly, the present invention relates to a method and apparatus of latching various interconnections to a portable electronic device.

BACKGROUND OF THE INVENTION

Portable telephone systems and personal digital assistants ("PDA") have gained widespread acceptance as an efficient means for voice and data communications. While early mobile units were large and complex, miniaturization has made possible hand-held units with full functional telephony capabilities allowing the user freedom to use a phone in a mobile environment or at a location remote from a hard wired connection to an existing telephone system. In addition, the cost of purchasing and using a portable phone has substantially declined and the quality and clarity of communication over a portable phone has increased causing increased and widespread demand for portable phones by the public. Such a demand has resulted in the competitive need for increased reliability in the portable phone and PDA.

Portable phones and PDA's typically include an electrical interface connector having both a power port and data port for charging and transferring data to the portable phone and PDA. Such an interface connector includes a dielectric elongate housing with electrically conductive terminals in each of the power port and data ports for electrically conducting and engaging with a power cable and data cable. The electrically conductive terminals are interconnected to circuitry in the portable phone and PDA.

The power cable and data cable are most often configured to engage with the interface connector and maintain such engagement with a latching system which holds the power cable and/or data cable in a mated condition. Such a latching system also is releasable to allow the power cable and/or data cable to be disengaged from the mated condition.

One of the problems with latching systems for the power cable and data cable described above is the potential of damage to the latches, themselves. In other words, too often the power cable and/or the data cable are hastily positioned and latched in a misaligned fashion which causes strain and fatigue on the latches. The result may be inadvertent damage to the latches. Often the latches of the latching system are formed from a polymeric material that experiences torque and stresses reducing the life span of the latches.

Another problem with such systems relates to the interface connector of the portable phone and PDA. Such an interface connector is a small, elongated and narrow structure which includes a housing molded of dielectric or polymeric material or the like. When latching cavities are formed in the very narrow housing along with the cavities for the power port and data ports, open spaces are created which tend to allow the molded plastic housing of the interface connector to bow. The interface connector is designed for mounting on a printed circuit board, and even the slightest bowing of the housing prevents the connector from lying completely flat on the circuit board.

SUMMARY OF THE INVENTION

It has been recognized that it would be advantageous to develop an improved method and apparatus for an interconnection system for a portable electronic device that provides a more reliable latching mechanism and a more simplified interface connector with improved structural characteristics and, further, provides greater efficiency in cost and time in manufacturing the interface connector.

The present invention relates to an interconnection system configured for a portable electronic device. The interconnection system includes an interface connector having a power port configured to be positioned at a peripheral portion of the portable electronic device. The interconnection system is directed to a latching contact mechanism that provides both electrical engagement and a latching mechanism between a power connector and the interface connector disposed in the portable electronic device.

Other features and advantages of the present invention will become apparent to those or ordinary skill in the art through consideration of the ensuing description, the accompanying drawings, and the appended claims.

BRIEF DESCRIPTION OF THE DRAWINGS

While the specification concludes with claims particularly pointing out and distinctly claiming that which is regarded as the present invention, the advantages of this invention may be ascertained from the following description of the invention when read in conjunction with the accompanying drawings, in which:

FIG. 7(*a*) illustrates an exploded perspective view of another embodiment of the power cable, depicting various components of the power cable;

DETAILED DESCRIPTION

Figure 1:
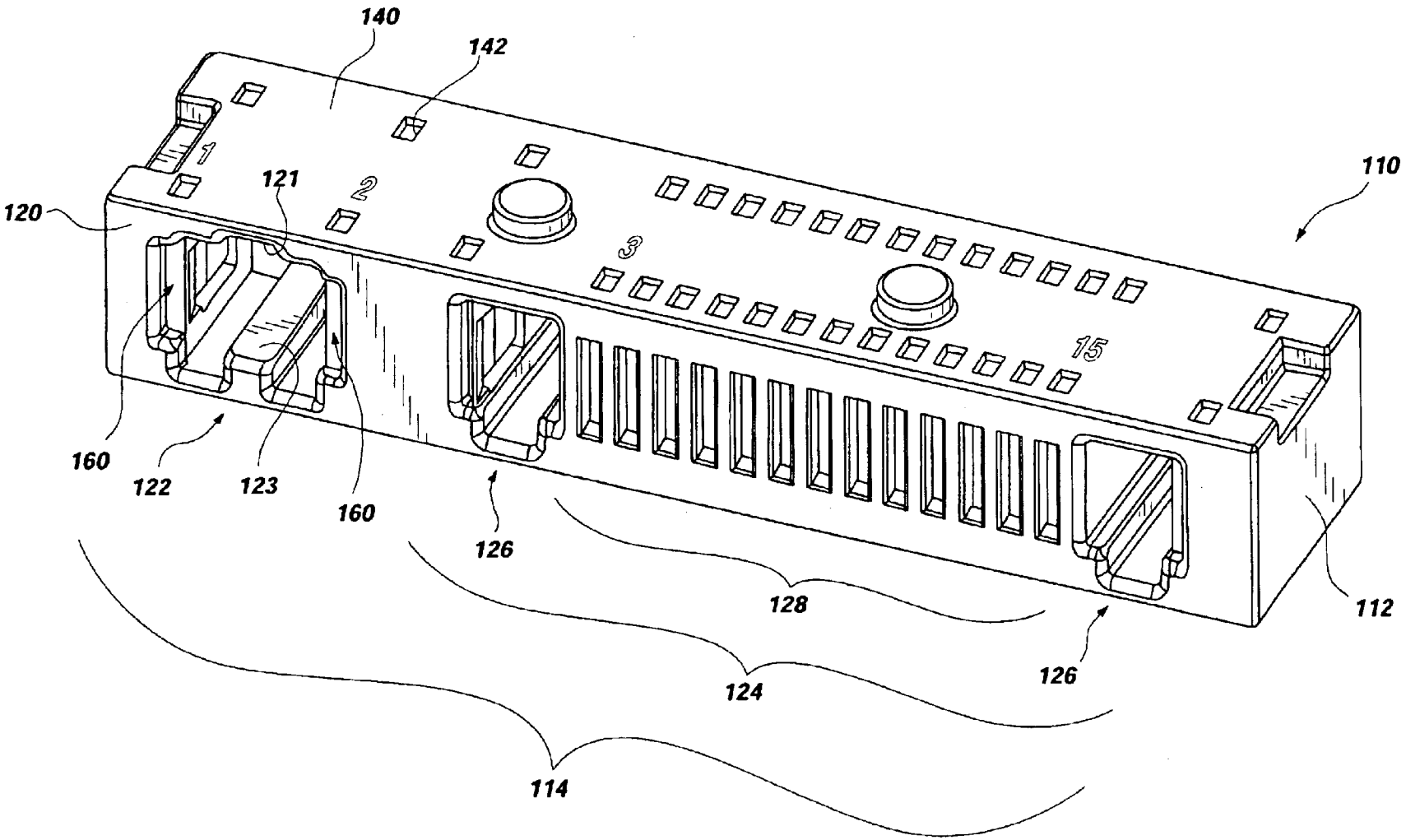
FIG. 1 illustrates a perspective front and top view of an elongate housing for an interface connector, depicting a power port and data ports defined in the front surface of the interface connector.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
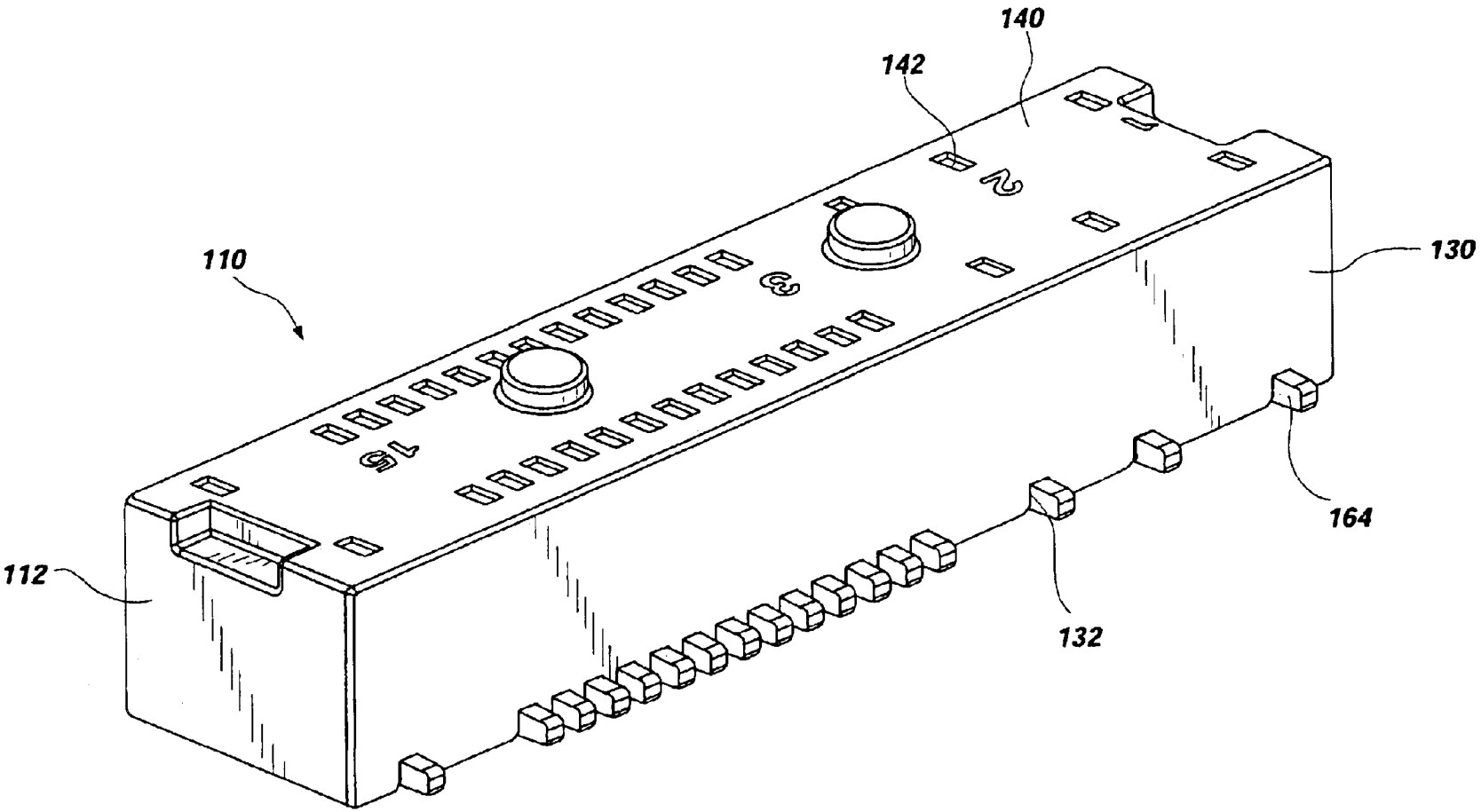
FIG. 2 illustrates a perspective back and top view of the interface connector having the electrically conductive strike plates, depicting a shoulder portion of the strike plates extending from a bottom, back surface of the interface connector.
Figure 3:
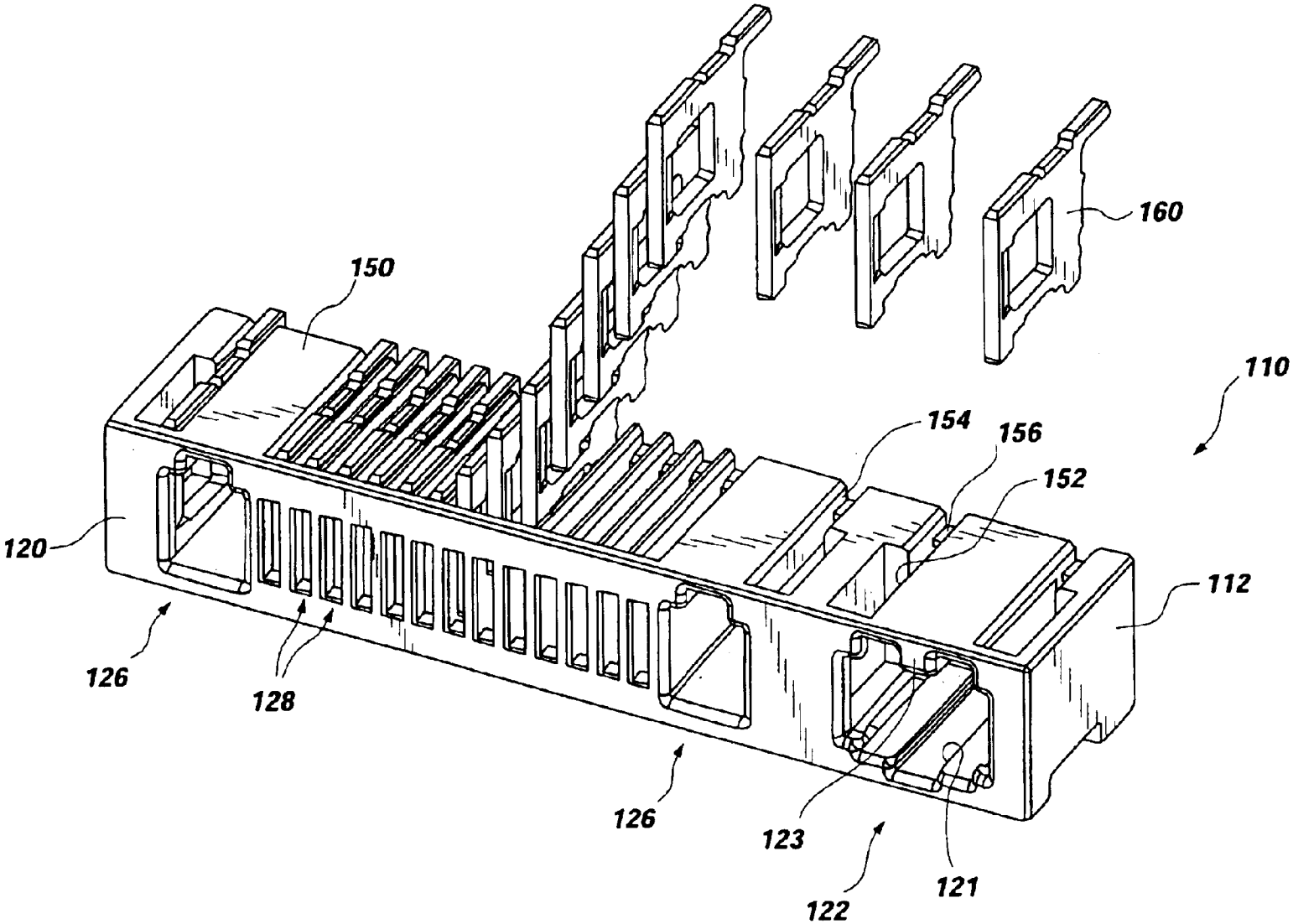
FIG. 3 illustrates a perspective bottom and front view of the interface connector, depicting the strike plates being received into the bottom surface of the elongate housing of the interface connector.

With reference to FIGS. 1–3 of the drawing figures, which are given by way of example, and not by way of limitation, respective front, back and bottom perspective views of an interface connector 110 are illustrated. The interface connector 110 is configured to be positioned proximate an inside peripheral portion of a portable electronic device (not shown), such as a personal digital assistant ("PDA") and/or a portable phone. The interface connector 110 is configured to interface with a power cable and/or a data cable (not shown) to provide power and data transfer to circuitry in the PDA and/or wireless phone, illustrated and described in further detail hereafter.

The interface connector 110 can include an elongate housing 112 having an elongated cubic shape defining a plurality of different types of interface ports 114 therein. With such elongated cubic shape, the elongate housing 112 includes a front surface 120, a back surface 130, a top surface 140 and a bottom surface 150. The elongate housing 112 can be formed from a dielectric material, such as a polymeric or polyimide material. Other suitable dielectric materials can also be utilized, such as a ceramic or composite.

The front surface 120 of the elongate housing 112 includes the plurality of interface ports 114 formed therein. The front surface 120 with the ports 114 defined therein are configured to be exposed at a peripheral portion of the portable electronic device. The plurality of ports 114 can include a power port 122 and data ports 124. The power port 122 can be a single cavity extending from the front surface 112 into a portion of the elongate housing 112. The power port 122 can include an elongate groove 121 in one of the surfaces therein and an elongate protrusion 123 on another one of the surfaces, such as an opposing surface to the groove 121. Such elongate groove 121 and elongate protrusion 123 within the power port 122 can serve to control the polarity with which the power cable (not shown) is inserted into the power port 122.

The data ports 124 can include multiple cavities, which may include data latching ports 126 configured for latching a data cable thereto and data signal ports 128 for transmitting data therethrough. In one embodiment, the data latching ports 126 can include power and ground contacts if desired so that the data ports 124 can be utilized for both transmitting data through the data signal ports and transmitting power through the data latching ports 126. Such power port 122 and data ports 124 can extend partially into the front surface 120, without extending through the back surface 130. As with the power port 122, the data latching ports 126 can also include various configurations, such as grooves and/or protrusions, to control the polarity by which the data connector (not shown) is inserted into the data latching ports 126.

The top surface 140 can include multiple alignment retaining openings 142 defined therein. Each of the alignment-retaining openings 142 extends through the top surface 140 and into one of the plurality of interface ports 114. Each interface port 114 can include at least two alignment-retaining openings 142, wherein the power port 122 can include at least four alignment-retaining openings 142.

With respect to FIG. 3, the bottom surface 150 can include plate openings 152 defined in the elongate housing 112. Each plate opening 152 is sized and configured to receive a strike plate 160. Each plate opening 152 extends through the bottom surface 150 into a corresponding one of the ports 114 (see FIG. 1). Also, each plate opening 152 defines a channel portion 154 in the bottom surface 150. The channel portion 154 extends from an edge of the plate opening 152 to an edge of the bottom surface 150 and into the back surface 130 so as to define a notch 132 (FIG. 2) in the back surface 130 of the elongate housing 112. The channel portion 154 includes a stopper 156 which is defined in a substantially parallel plane as the bottom surface 150.

Further, each plate opening 152 is aligned and configured to correspond with at least two of the alignment-retaining openings 142 (FIG. 2). Such alignment between the plate openings 152 in the bottom surface 150 and the alignment-retaining openings 142 in the top surface 140 provides a mechanism for inserting, aligning and retaining strike plates 160 into the elongate housing 112. It should be noted that such plate openings 152 are not limited to being formed in the bottom surface 150 and may be formed in other surfaces in the elongate housing, such as the back surface 130 and top surface 140.

Figure 4:
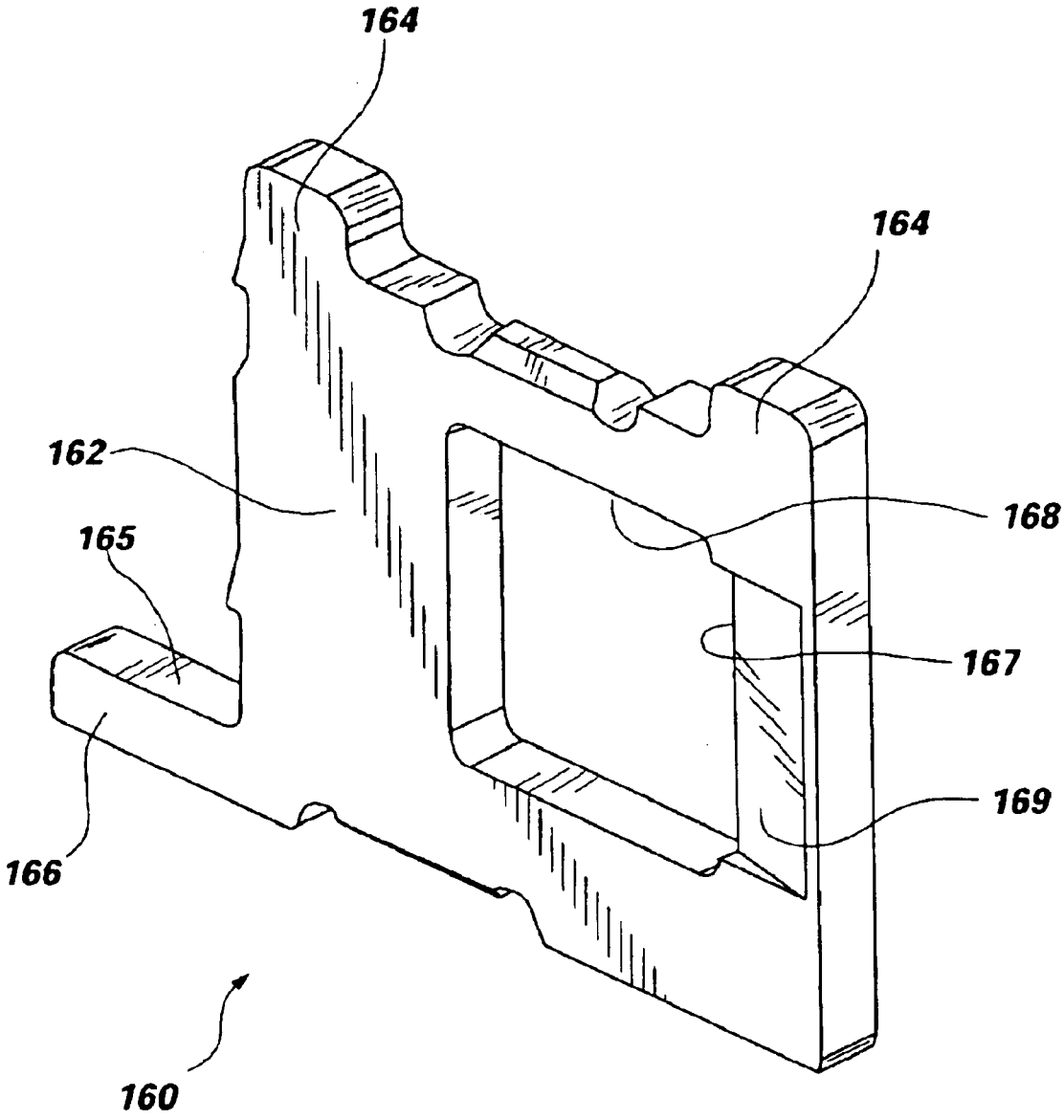
FIG. 4 illustrates an enlarged perspective view of one embodiment of a strike plate, depicting one strike plate configuration having a contact portion and window defined in the strike plate and a hanging shoulder extending therefrom.

With reference to FIG. 4, a strike plate 160 is illustrated. The strike plate 160 is a conductive material configured for conducting power and/or signals therethrough. The strike plate 160 can be any suitable electrically conductive material, such as phosphor bronze or titanium copper or alloys thereof. Further, the strike plate 160 can be gold plated for optimal conductivity and minimal degradation. Such gold plating may be employed by electrolysis or electrolytic processes.

Referring to FIGS. 3 and 4, the strike plate 160 includes a main plate portion 162 having at least two extension portions 164 extending upward from the main plate portion 162 and a shoulder portion 166 extending laterally from the main plate portion 162. The at least two extension portions 164 are sized and configured to slide and fit in the alignment-retaining openings 142. The shoulder portion 166 is configured to sit in the channel portion 154 so that a top surface 165 thereof abuts against the stopper 156 in the channel portion 154 of the elongate housing 112. The main plate portion 162 also defines a window 168 therein with a contact portion 169 immediately adjacent thereto. The window 168 defines a blocking surface 167 at an end of the contact portion 169. The contact portion 169 of the strike plate 160 can be a sloping or tapered notch such that a thickness of the strike plate 160 varies along a length toward the blocking surface 167 of the strike plate 160 and, specifically, the thickness of the strike plate 160 can decrease toward the blocking surface 167. In this manner, the blocking surface 167 and the contact portion 169 defined in the strike plate 160 can act in conjunction to slidingly receive, engage and latch with an interconnect device, such as a portion of a power cable and/or a data cable (not shown). Similarly, the blocking surface 167 and contact portion 169 of the strike plate 160 are configured to facilitate sliding disengagement of the power or data cable from the interface connector 110 with an appropriate break-away force.

Figure 5:
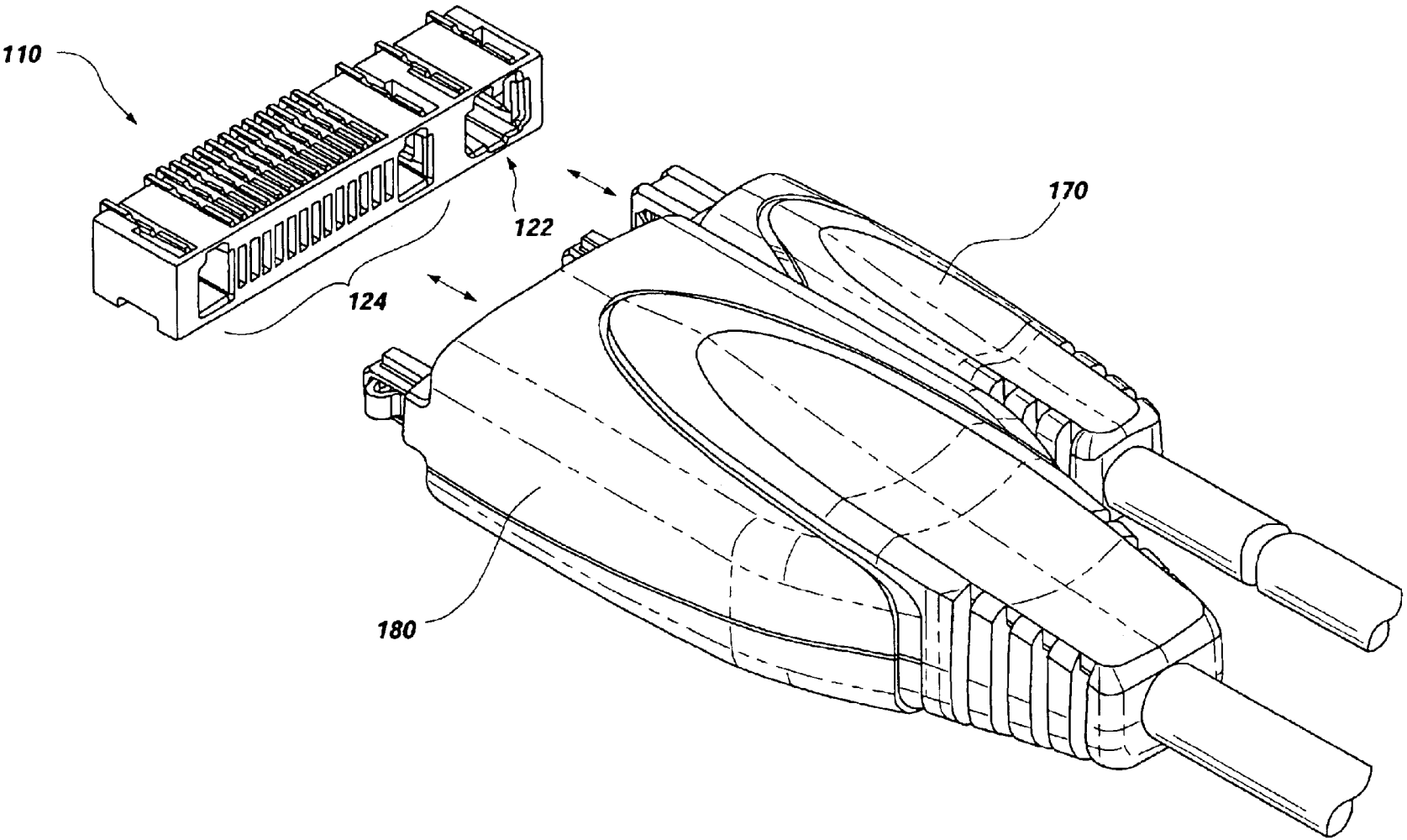
FIG. 5 illustrates a perspective view of each of the interface connector with the power port and data port correspondingly aligned with a power cable and a data cable in a disengaged position.

FIG. 5 illustrates the interface connector 110 with the power port 122 and data ports 124 facing and aligned with a power cable 170 and a data cable 180 in a disengaged position. In particular, the power port 122 is aligned with and configured to receive, electrically contact and latch with the power cable 170. The data latching ports 126 are configured to receive and latch with the data cable 180. As previously indicated, the data latching ports 126 can be configured to include power junctions to electrically interconnect with the data cable 180.

Figure 6:
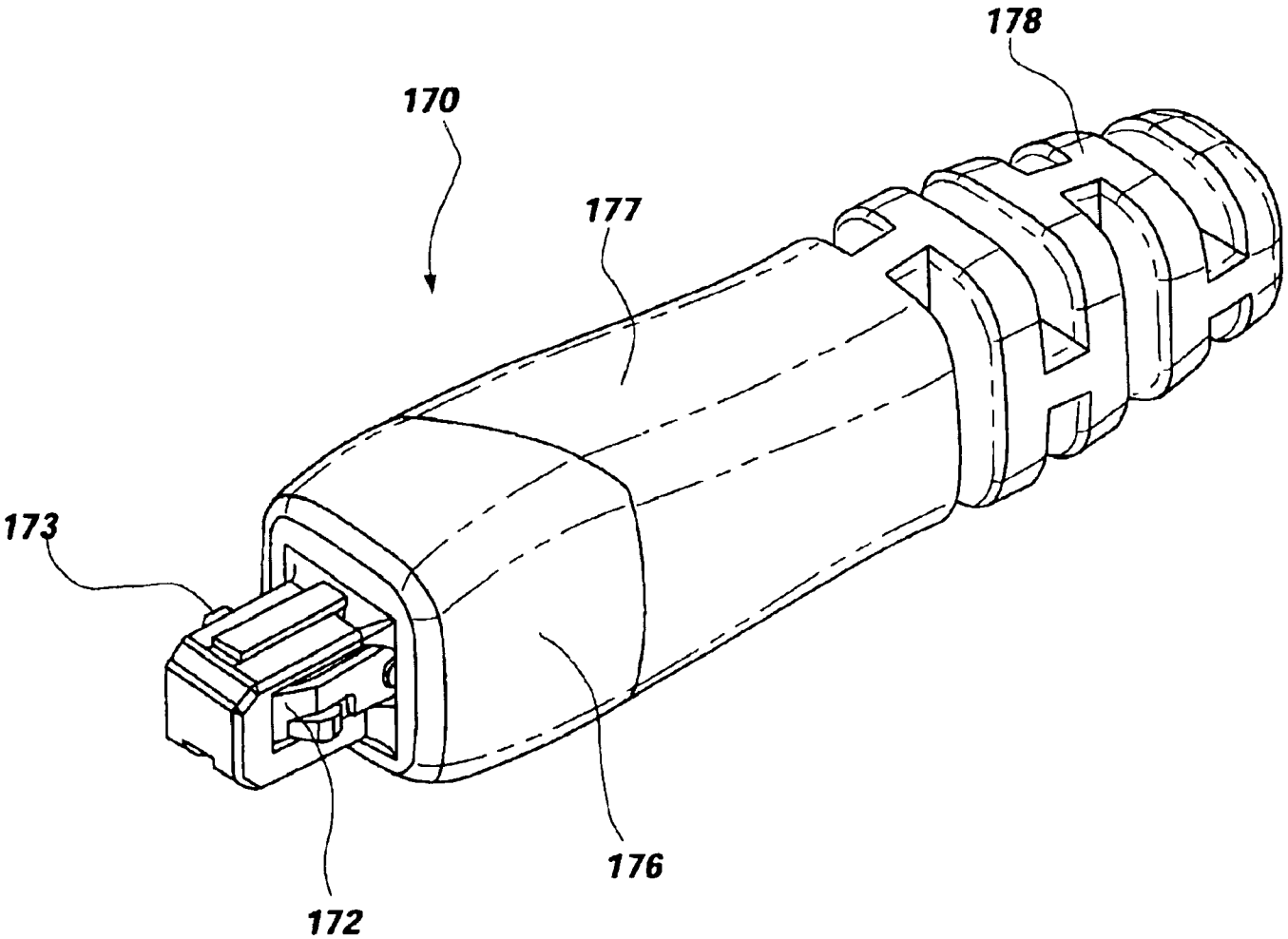
FIG. 6 illustrates an enlarged perspective view of the power cable configured to interconnect with the power port in the interface connector.
Figure 7:
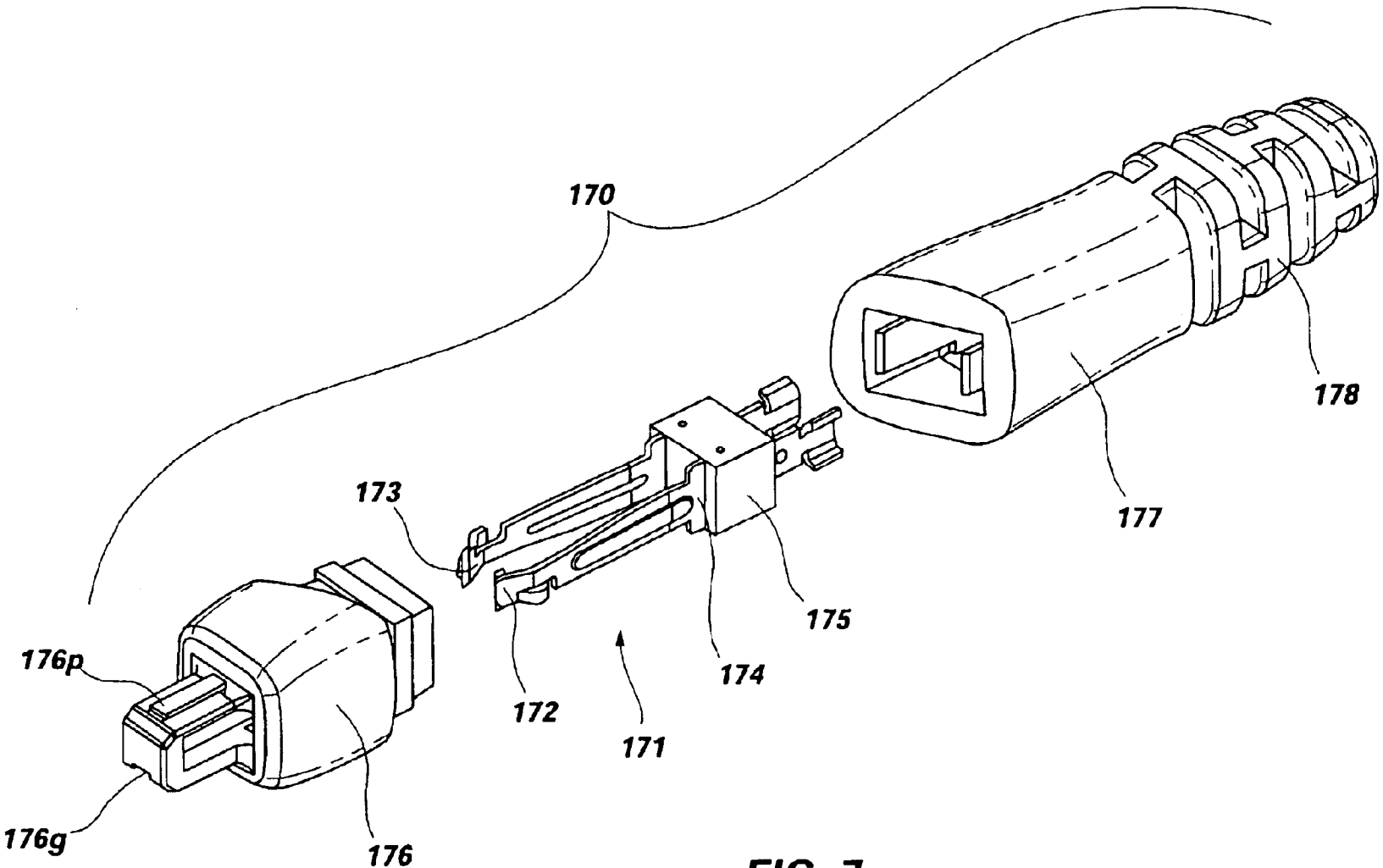
FIG. 7 illustrates an exploded perspective view of the power cable, depicting various components of the power cable.
Figure 7A:
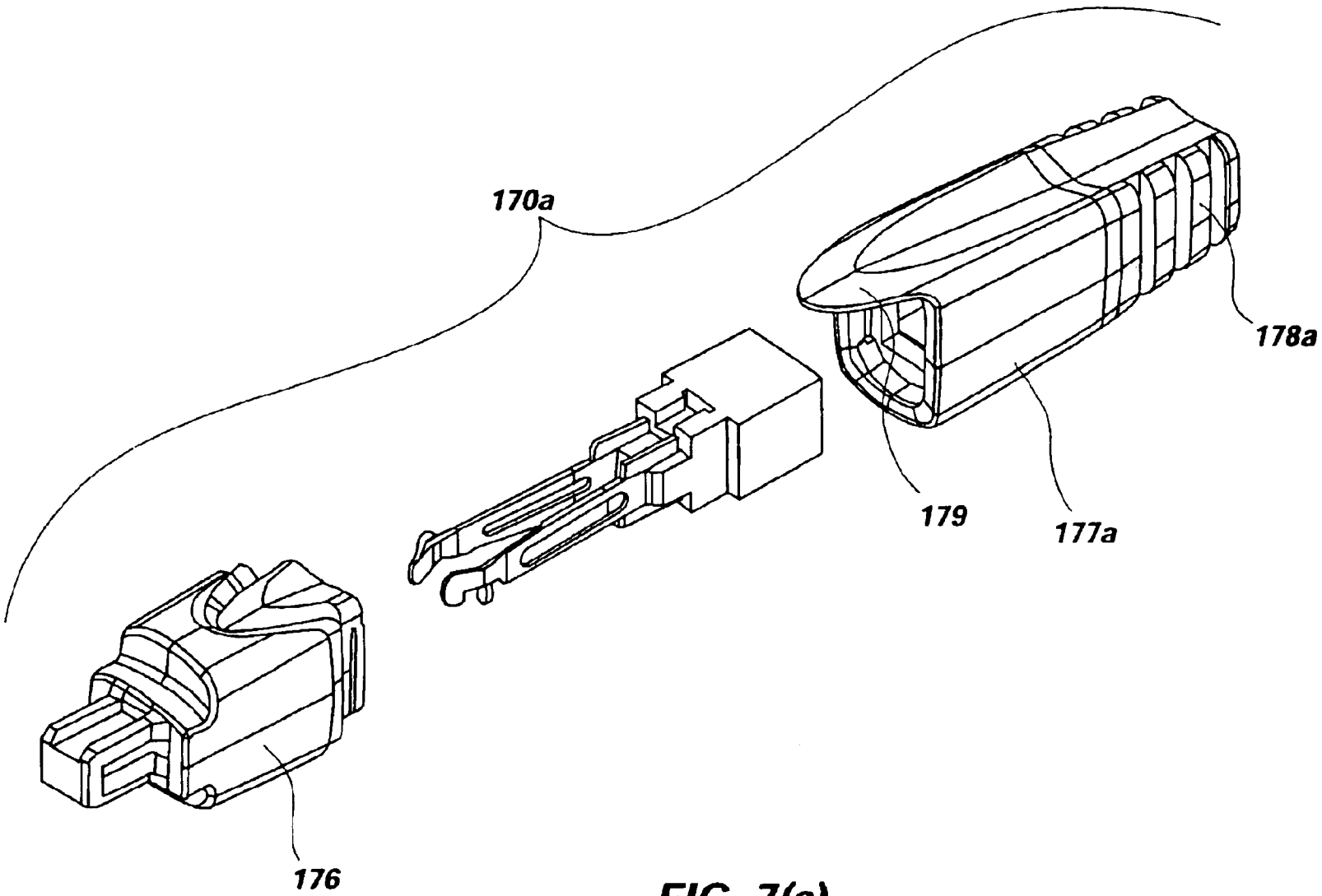
Figure 8:
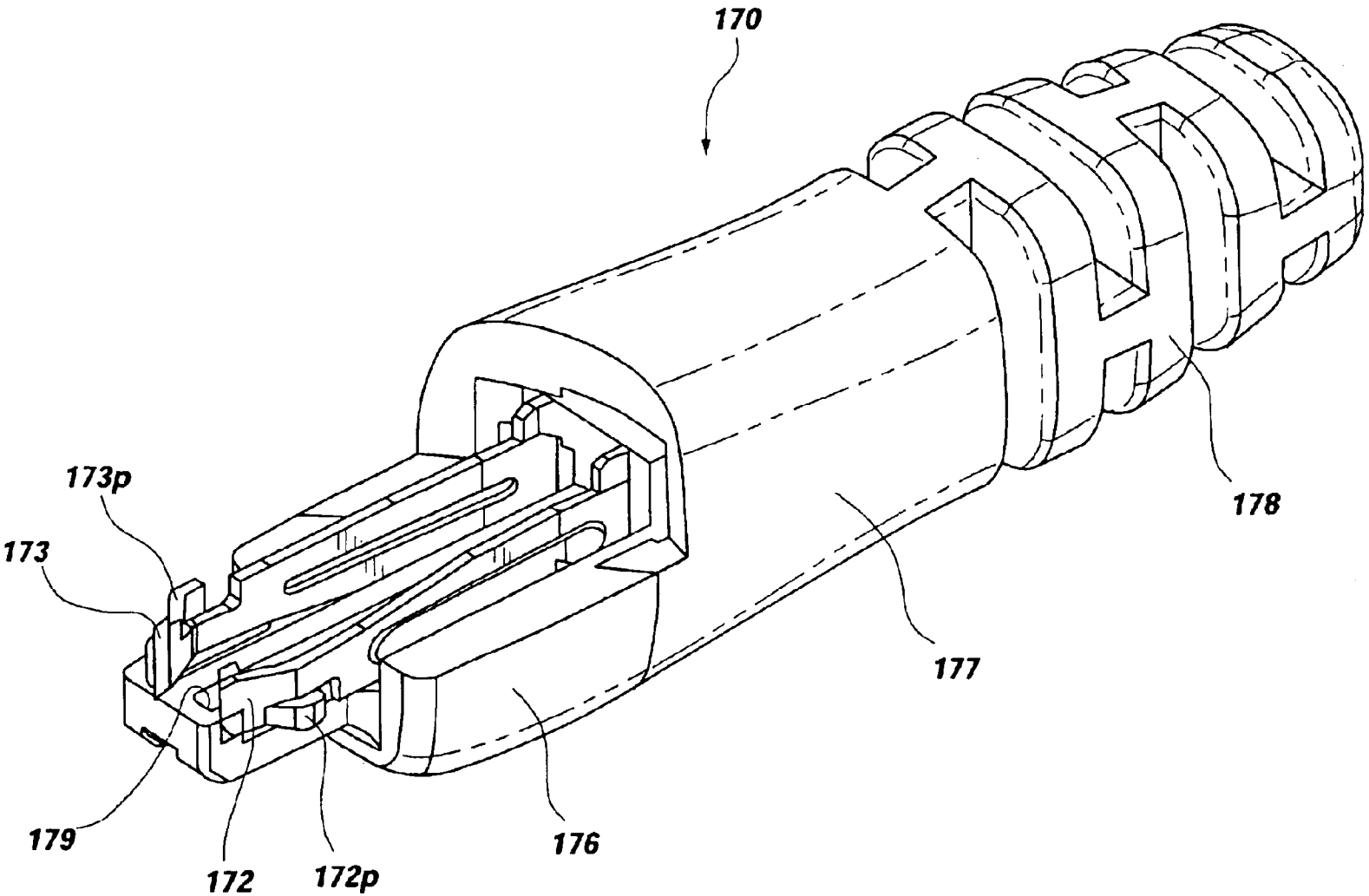
FIG. 8 illustrates a partial perspective view of the power cable having a cut-out portion depicting a space for the electrical contacts in the power cable to move therein.

Turning to FIGS. 6 through 8, the power cable 170 previously referred to herein is illustrated. With reference to FIGS. 1, 6 and 7, the power cable 170 includes latching contacts 171 having a ground contact 172 and a power contact 173. An insert molded cap 175 is formed around a mid-base portion 174 of the latching contacts 171 to maintain electrical separation between the ground and power contacts 172 and 173. The latching contacts 171 and cap 175 are housed in a contact housing 176, wherein the contact housing is connectable to a cable housing 177. The cable housing 177 includes strain relief ribs 178 in which a cable (not shown) may extend therefrom. The contact housing 176 includes an insertion mechanism having an elongate protrusion 176*p* and an elongate groove 176*g* defined in opposing surfaces of the contact housing 176. Such an elongate protrusion 176*p* and elongate groove 176*g* are configured to correspond with respective elongate groove 121 and elongate protrusion 123 defined in the power port 122 to ensure proper alignment and insertion of the power cable 170 in the power port 122 to correspond with the ground contact 172 and power contact 173 of the power cable 170.

The latching contacts 171 can be configured to be spring biased in an outward direction so as to bias outwardly when moved to an inward position and, specifically, configured to be moved inwardly and outwardly when being engaged and disengaged with the power port 122 and engaging the strike plates 160. As depicted in a cut-out portion of the contact housing 176 in FIG. 8, the latching contacts 171 can be inwardly movable through a recess portion 179 defined in the contact housing 176. Each of the ground contact 172 and the power contact 173 can include respective protrusions 172*p* and 173*p* or a nub configured to latch with the blocking surface 167 defined by the window 168 of the strike plate 160 while also providing a biasing contact between the latching contacts 171 and the contact portion 169 of the strike plate 160. Each of the latching contacts 171 can also be formed with a recessed portion, bent portion and/or a rippled portion configured to correspond with the strike plate 160 configuration and further enhance both the electrical contact and latching mechanism with the strike plates 160 in the power port 122.

FIG. 7(*a*) illustrates another embodiment of the power cable 170*a*. In this embodiment, the power cable 170*a* is substantially the same as the power cable depicted in FIG. 7, except in this embodiment the configuration of the cable housing 177*a* and strain relief ribs 178*a* are sleeker in appearance. Also, the cable housing 177*a* includes an outward extending flap 179 configured to interconnect with the configuration of the contact housing 176.

In another embodiment, the strike plates can include a springing latch element configured to latch to contacts of the power cable. As such, the interconnection of this embodiment both latches and electrically conducts, but in a reverse configuration of the interconnection previously described between the power port and the power cable.

Figure 9:
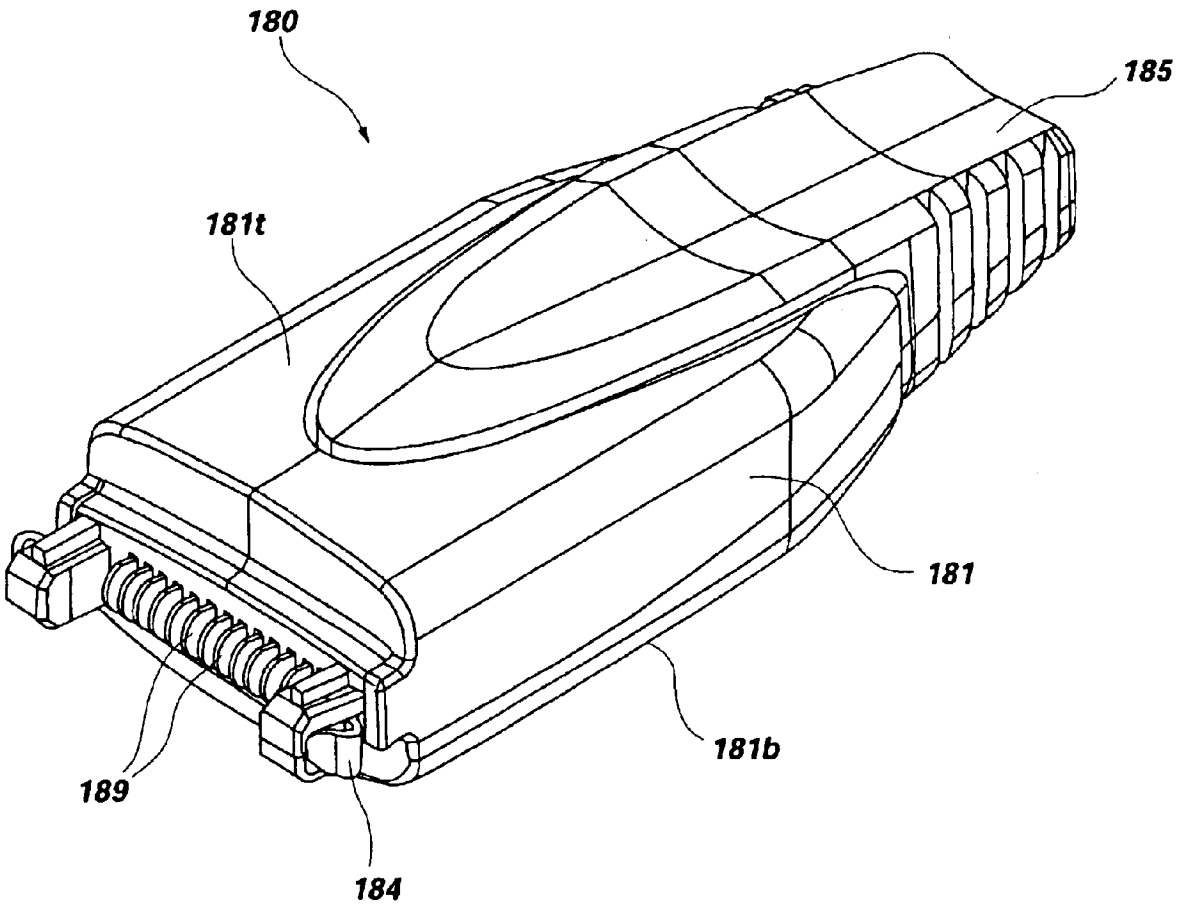
FIG. 9 illustrates an enlarged perspective view of the data cable configured to interconnect with the data ports in the interface connector.
Figure 10:
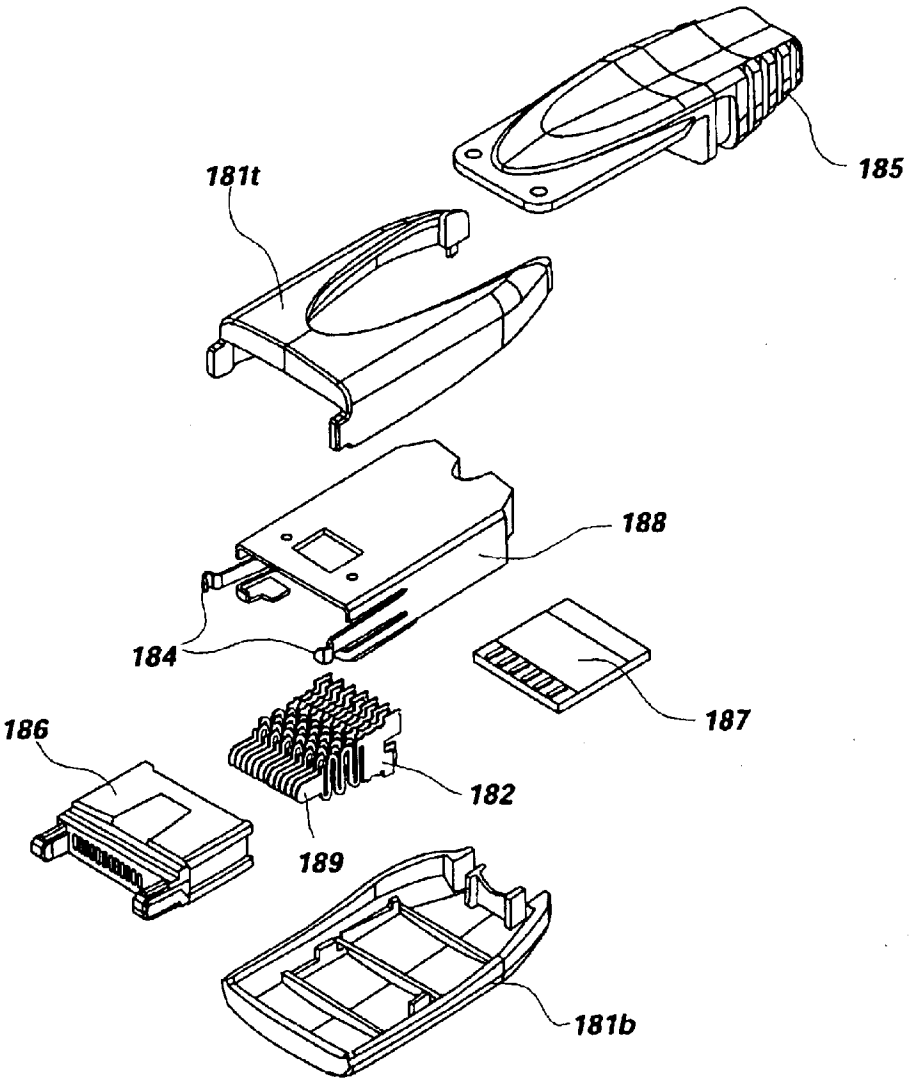
FIG. 10 illustrates an exploded perspective view of the data cable, depicting various components of the data cable.

Referring to FIGS. 9 and 10, a data cable 180 is illustrated. The date cable 180 includes a cover 181 having a bottom piece 181*b* and top piece 181*t*, which houses each of a signal contact member 182, a contact housing 186, a data printed circuit board ("PCB") 187 and a shield 188. The signal contact member 182 includes signal contact points 189 extending from a front-end portion thereof. The shield 188 is configured to include latches 184 extending from a front portion thereof. The contact housing 186 houses the signal contact member 182 with the data PCB 187 interconnected thereto, which are each positioned within an interior of the shield 188. The bottom and top pieces 181*b* and 181*t* of the cover 181 are then configured to sandwich and house the above-described components of the data cable 180 in a manner so as to expose the signal contact points 189 and the latches 184 at a front portion of the data cable 180. The cover 181 can also sandwich a front portion of a strain relief member 185 so that the strain relief member 185 extends from a back portion thereof through which a cable (not shown) for transmitting the data may extend. With this arrangement, the interface connector 110 having the data latching ports 126 can receive, engage and disengage with the latches 184 of the data cable 180 so that the signal contact points 189 engage with the strike plates 160 in each of the data signal ports 128.

In another embodiment, the latches 184 extending from the shield 188 of the data cable 180 can function as power contacts as well as latches 184. In this embodiment, one of the signal contact points 189 can function as a ground contact. In still another embodiment, it is contemplated that one of the latches 184 can be configured as a ground contact while the other one of the latches 184 can be configured as a power contact while also functioning as a latching mechanism.

It can therefore be readily recognized by one of ordinary skill in the art that the strike plate 160 configuration disposed in the interface connector 110 provides both a latching mechanism and an electrical interconnection mechanism with the latching contacts 171 of the power cable 170. Such strike plates 160 in the interface connector 110 are configured to engage and disengage with the latching contacts 171 of the power cable 170 via the spring loaded movement of the latching contacts 171 and the protrusions 172*p* and 173*p* extending therefrom. In this manner, the spring loaded latching contacts 171 secure the power cable 170 to the power port 122 and can be readily removed manually by pulling the power cable 170 away from the interface connector 110. The pulling force readily overcomes the spring biasing force securing the power cable 170 to the power port 122 to move the latching contacts 171 inward to, thereby, allow the power cable 170 to slide out of the power port 122.

Likewise, strike plates 160, identical to those used for the power port 122, are also used for the data ports 124. Therefore, the data latching ports 126 can provide both a latching mechanism and an electrical interconnection mechanism with the latches 184 of the data cable 180. As such, the data ports 124 having the strike plates 160 disposed therein can be configured to readily engage and disengage with the data cable 180 as previously described for the power cable 170.

The duel function of both latching and electrically conducting provided by the latching contacts 171 and strike plates 160 simplifies the design of both the interface connector 110 and power cable 170. In particular, by eliminating the requirement of forming separate latching cavities in the interface connector for latching the power cable thereto, the number of cavities formed in the interface connector 110 is reduced. Such a reduction in cavities simplifies the configuration and increases the structural integrity and strength of the interface connector 110 and, specifically, reduces the potential chances of the small elongate housing 112 from slightly warping, resulting in an inoperable interface connector. By simplifying the interface connector design, the interface connector also is more easily manufactured with less chance of error.

It can also be readily recognized by one of ordinary skill in the art that the power cable 170 will have a greater fatigue life than conventional power cables having latches, which are formed from a polymeric material and separate from the electrical contact. Rather, the latching contacts 171 described herein are formed of a durable metallic, electrically conductive material configured to hold-up against inadvertent torques and stresses placed on the latching contacts. Further, the latching contacts are housed in the contact housing 176, which substantially eliminates the ability for inadvertent torques and stresses placed on the latching contacts.

As previously set forth, the strike plates 160 are configured such that they provide both a securing mechanism as well as conduct electricity therethrough. Each of the interface ports 114 are configured to receive an identical strike plate 160 and, therefore, each of the power port 122, data latching ports 126 and data signal ports 128 can perform the latching function or electrical conducting function, or both. Such a strike plate 160 further simplifies the manufacturing process of forming the interface connector 110 in minimizing cost and time required for preparing the interface connector 110. Such interface connector 110 featuring the ability to utilize identical strike plates 160 also provides greater throughput in minimizing the potential for error in the final product of the interface connector 110.

Figure 11:
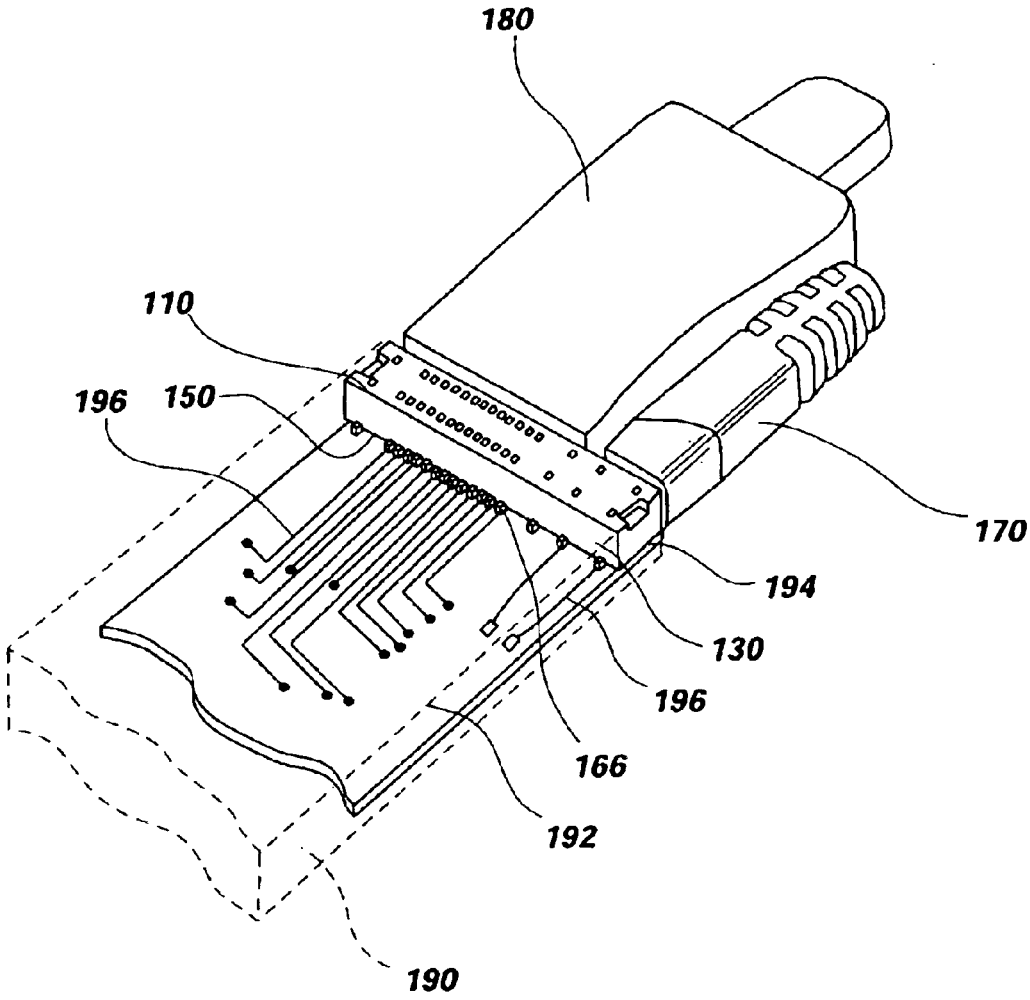
FIG. 11 illustrates a simplified perspective view of a portable electronic system, depicting the interface connector interconnected to the system and the interface connector engaged with the power cable and the data cable.

With reference to FIG. 11, a portable electronic device 190 having the interface connector 110 therewith is illustrated. The portable electronic device 190 includes a PCB 192 to which the interface connector 110 is electrically interconnected. The interface connector 110 is attached at an end portion 194 of the PCB 192 so that the shoulder portion 166 of the strike plate 160 exposed at the back and bottom surfaces 130 and 150 of the interface connector 110 can be in electrical communication with electrical interconnections and traces 196 on and/or in the PCB 192. In this manner, the interface connector 110 acts as an interface to power and transfer data to the portable electronic device 190 via the power cable 170 and data cable 180, respectively.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth herein.

What is claimed is:

1. A portable electronic device interconnection system, comprising:

a portable electronic device having an interface connector configured to be positioned therein, the interface connector including:

an elongate housing including a front side having a power port and a data port defined therein, the front side configured to be exposed at a peripheral portion of the portable electronic device; and strike plates configured to be positioned in the power port and the data port, each strike plate having a contact portion extending to a blocking surface defined therein; and a power connector configured to provide power to the portable electronic device through the power port of the interface connector, the power connector having latching contacts configured to both electrically engage with the contact portion of the strike plates and latch with the blocking surface of the strike plates in the power port of the portable electronic device.

2. The interconnection system of claim 1, wherein the latching contacts comprise a power contact and a ground contact each of which are electrically separate and are positioned adjacent to recesses defined in opposing sides of a contact housing of the power connector.

3. The interconnection system of claim 1, wherein the power connector further comprises a contact housing sized and configured to house the latching contacts and to be insertable into the power port, and wherein the latching contacts are configured to be spring biased outward and are configured to be movable inward into recesses defined in opposing sides of the contact housing to facilitate both electrically engaging and latching with the power port.

4. The interconnection system of claim 1, further comprising a data connector configured to removably interconnect with the data ports to transfer data to and from the portable electronic device.

5. The interconnection system of claim 1, wherein the strike plates are configured to be positioned on opposing sides of the power port to electrically engage and latch to the latching contacts.

6. The interconnection system of claim 1, wherein the strike plates are insertable in a bottom side, adjacent to the front side, of the elongate housing, the strike plates having a shoulder portion positioned against the bottom side and electrically interconnected to a printed circuit board in the portable electronic device.

7. A power connector configured to power a portable electronic device through a power port of an interface connector, the power connector comprising:

a contact housing having first and second recesses defined in respective opposing sides of the contact housing; and first and second latching contacts comprising a power contact and a ground contact, respectively, each of which maintain electrical separation via the contact housing, the latching contacts being configured to be positioned adjacent the respective first and second recesses defined in the contact housing, the first and second latching contacts configured with outward spring bias and configured to be movable inward into the respective first and second recesses, the latching contacts configured to both (1) electrically engage to transfer power to the portable electronic device, and (2) latch to the power port of the interface connector to power the portable electronic device.

8. The power connector of claim 7, wherein the latching contacts comprises an electrically conductive material.

9. The power connector of claim 7, wherein the latching contacts comprise a protrusion configured to bias against the power port and latch thereto.

10. A conductive terminal configured to be positioned in an interface connector of a portable electronic device, the conductive terminal comprising:

a strike plate having a window opening and a contact portion and a shoulder extension, the shoulder extension extending outward from a lower portion of the strike plate configured to electrically interconnect with a printed circuit board of the portable electronic device, the contact portion including a beveled surface extending to a blocking surface of the strike plate, the blocking surface configured as a portion of a periphery of the window opening;

wherein the contact portion and the blocking surface of the strike plate are configured to both electrically engage and latch with an external power interconnection configured to provide power to the portable electronic device.

11. The conductive terminal of claim 10, wherein the strike plate comprises extension portions configured to align and retain the strike plate in the interface connector.

12. The conductive terminal of claim 10, wherein the strike plate is configured to be insertable at a bottom side of the interface connector, the bottom side adjacent to a front side at least partially exposed on the portable electronic device, with the shoulder extension configured to be retained in a channel at the bottom side of the interface connector.

13. The conductive terminal of claim 10, wherein the strike plate comprises an electrically conductive material.

14. The conductive terminal of claim 10, wherein the strike plate is configured as a latching mechanism and as an electrically conductive mechanism to be positioned in an interface connector for interconnection with at least one of a power connector and a data connector.

15. A method of powering a portable electronic device, the method comprising:

inserting a power connector having a contact housing into a power port defined in a peripheral portion of a portable electronic device, the power connector comprising—latching contacts having a power contact and a ground contact, each of which are electrically separate and are positioned adjacent to recesses defined in opposing sides of the contact housing; and engaging the latching contacts of the power connector with conductive plates positioned on opposite sides of the power port so that the latching contacts latch to the conductive plates as well as electrically conduct power through the conductive plates to power the portable electronic device.

* * * * *